United States Patent [19]

Wakimura

[11] 4,432,544

[45] Feb. 21, 1984

[54] FISHING TOY

[75] Inventor: Kazuo Wakimura, Tokyo, Japan

[73] Assignee: Mitsuwa Kogyo Co., Ltd., Tokyo, Japan

[21] Appl. No.: 310,733

[22] Filed: Oct. 13, 1981

[30] Foreign Application Priority Data

Oct. 16, 1980 [JP] Japan ..... 55-147246[U]
Oct. 16, 1980 [JP] Japan ..... 55-147247[U]

[51] Int. Cl.[3] ..... A63F 9/00

[52] U.S. Cl. ..... 273/1 M; 275/140; 46/242; 46/235

[58] Field of Search ..... 46/242, 238, 236, 241, 46/239, 45, 123, 240; 273/140, 1 M, 1 R

[56] References Cited

U.S. PATENT DOCUMENTS

| | | | |
|---|---|---|---|
| 622,545 | 4/1899 | Schoknecht et al. | 273/140 UX |
| 1,910,863 | 5/1933 | Sullivan | 273/140 |
| 4,021,042 | 5/1977 | Sweeton | 273/1 M X |
| 4,214,750 | 7/1980 | Shimizu | 273/140 X |

*Primary Examiner*—Mickey Yu
*Attorney, Agent, or Firm*—Young & Thompson

[57] ABSTRACT

A fishing toy having a rotatable disc supporting a plurality of small toy magnetic bodies thereon. A plurality of magnets arranged under the disc to cause the magnetic bodies to overturn. Fishing rods, each having a suspended magnet, are movably mounted on a base to fish up the magnetic bodies individually.

8 Claims, 4 Drawing Figures

FISHING TOY

FIELD OF THE INVENTION

This invention relates to a fishing toy comprising small toy bodies capable of overturning by use of a magnet.

BACKGROUND OF THE INVENTION

A fishing toy is known, which has a fishing rod suspending from its upper end a permanent magnet, with which toy fishes distributed on a flat surface of a rotatable disc are fished up.

However, the fishing toy of such type has the drawback that the permanent magnets each contained in the small toy body such as a fish toy, allow a number of toy bodies to be attracted and firmly connected with each other when they are distributed on the turning disc, resulting in the impossibility of fishing up one toy body after the other individually.

In accordance with the invention, the drawback mentioned hereinbefore has been solved by a new combination of small toy bodies in a fishing toy, in which a rotatable disc is provided on its upper surface with a plurality of receiving parts, such as recesses, separated from each other for accommodating the small toy bodies in order to prevent each toy body from attracting adjacent toy bodies even when a plurality of such small toy bodies of magnetic material are distributed on the upper surface of the rotatable disc.

Furthermore, in accordance with the invention, the magnetic attracting and repelling forces generated between the two magnets are used for overturning the small toy body, which is placed in the receiving part of the rotatable disc, within this receiving part as the disc turns. The small toy bodies in the receiving part have their poles extending vertically, while the fishing magnet suspended from the top end of the fishing rod also has its poles extending vertically, so that the fishing magnet can fish up the small toy body when the fishing magnet has a different polarity from that of the small toy body but cannot fish up the toy body when the fishing magnet and the toy body have same polarities, thereby providing a more amusing toy.

SUMMARY OF THE INVENTION

Accordingly, a general object of the invention is to provide an amusing fishing toy in which a plurality of small toy bodies may be overturned without attracting each other on a rotatable disc, thereby permitting each small toy body to be fished up individually.

A principal object of the invention is to provide a fishing toy comprising a plurality of small toy bodies each containing a magnet therein, a rotatable disc consisting of a non-magnetic body and having a plurality of receiving parts each accommodating a small toy body individually, a base for rotatably mounting the rotatable disc, driving means mounted to the base for driving the rotatable disc, magnets arranged under the disc each corresponding to the receiving part for overturning the small toy body with its repelling force, and a fishing rod provided with a magnet for fishing up and holding the small toy body by magnetic attraction.

PREFERRED EMBODIMENT OF THE INVENTION

In accordance with the invention, the driving means for turning the disc may comprise a friction wheel in contact with the periphery of the disc and a motor for driving the friction wheel. The magnet for overturning the small toy bodies with its repelling force may comprise a permanent magnet. Alternatively, the magnet for overturning the small toy bodies with its repelling force may comprise an electromagnet capable of switching its polarity. The magnet for overturning the small toy body with its repelling force is preferably mounted on a second rotatable disc which turns in the opposite direction to, or in the same direction as the main rotatable disc but at a different speed. The fishing rod is preferably swingably held on a support arranged on the base corresponding to the turning disc and is capable of moving the fishing magnet up and down. The fishing magnet is preferably received in a holding part of a non-magnetic body attached to a suspending rod at its lower end, wherein the suspending rod is suspended from the upper end of the fishing rod.

The invention will be described in more detail hereinbelow with reference to the accompanying drawings.

DETAILED DESCRIPTION OF THE INVENTION

Figure 1:
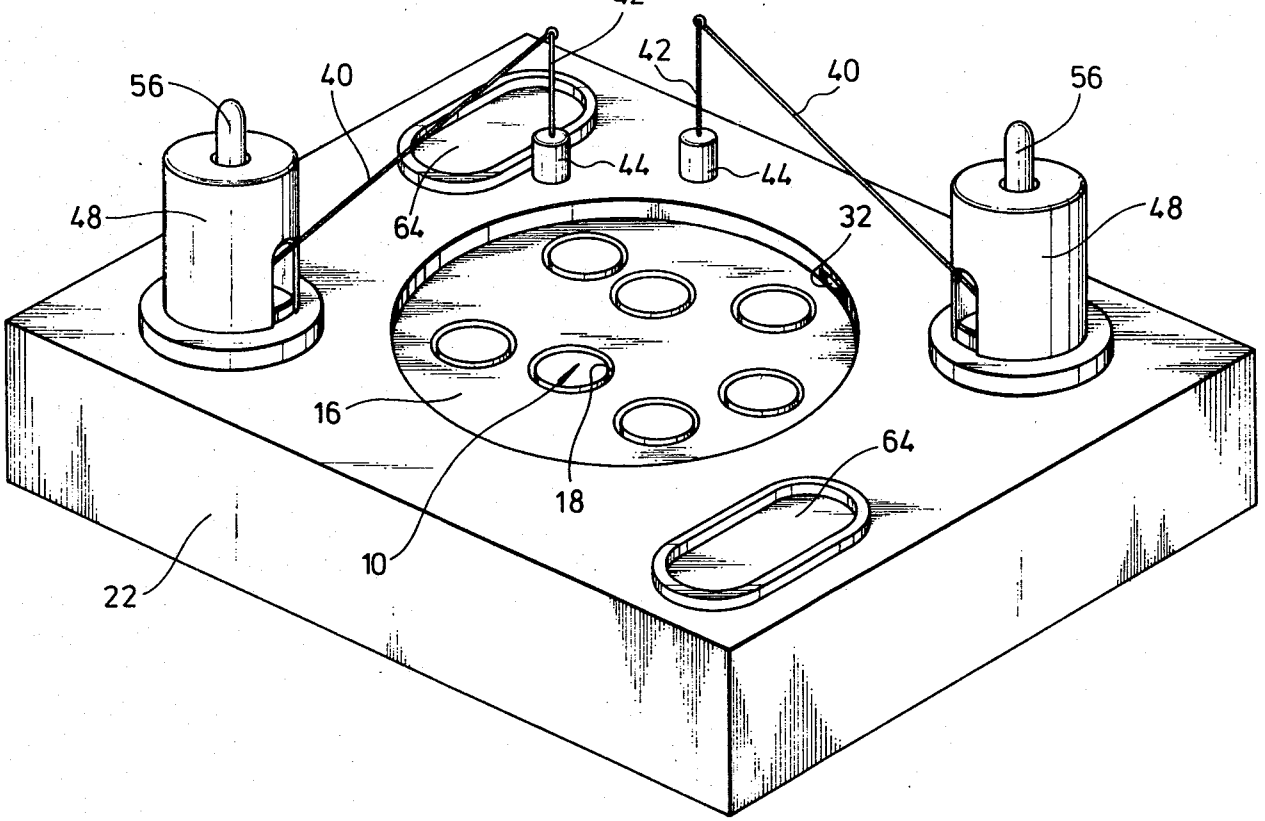
FIG. 1 is a perspective view of one embodiment of the fishing toy according to the invention.
Figure 2:
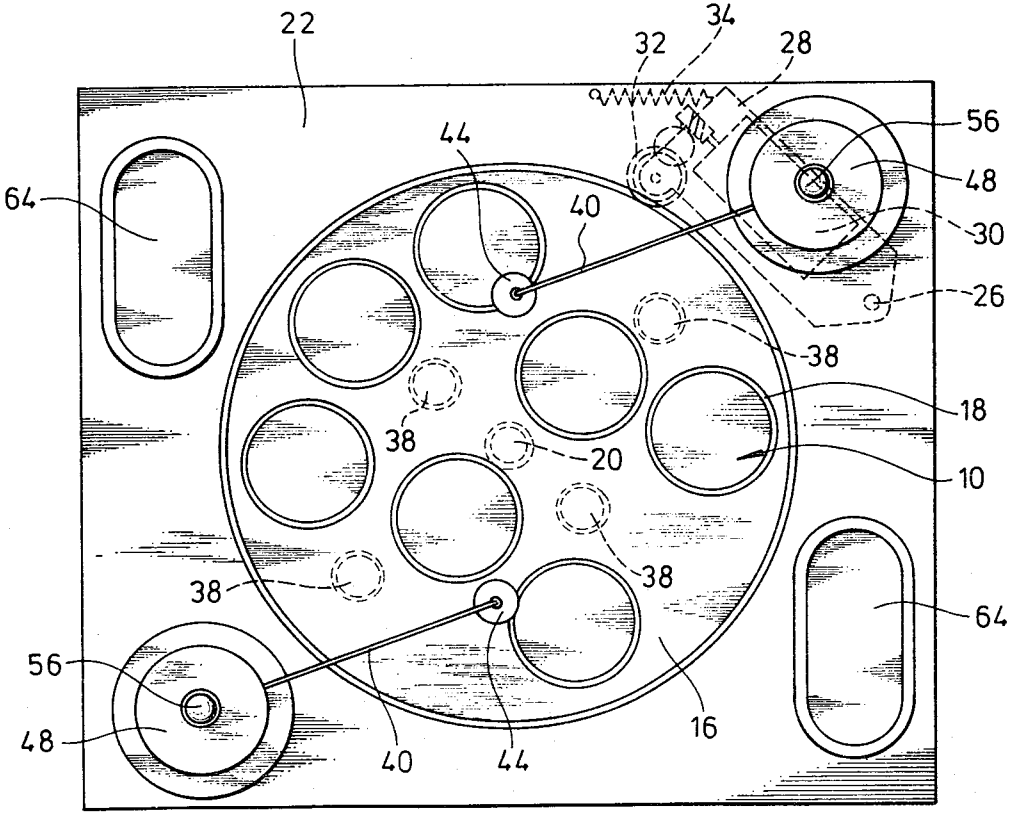
FIG. 2 is a plan view of the toy as shown in FIG. 1.
Figure 3:
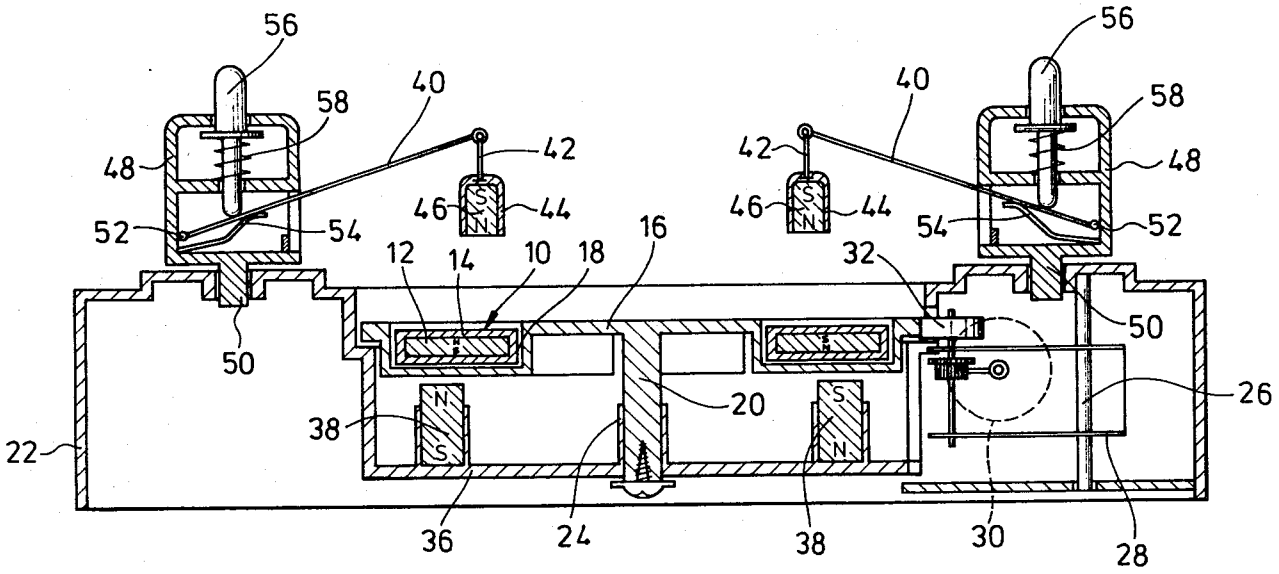
FIG. 3 is a vertical sectional view of the toy as shown in FIG. 1.

One embodiment of the fishing toy according to the invention is illustrated in FIGS. 1 to 3. In the toy of this embodiment each of the small toy bodies 10 in the form of a disc contains a permanent magnet 12 with its N and S poles disposed in the vertical direction, which is provided on its surface with a plastic coating 14. These small toy bodies 10 are accommodated in receiving parts 18, for example, in the form of cylindrical recesses, which are formed on the upper surface of a rotatable disc 16. The rotatable disc 16 is formed from rigid plastics or other non-magnetic material.

The rotatable disc 16 is provided with a shaft 20 suspended from its center, which shaft is rotatably supported on a bearing 24 protruding from a base 22 of rigid plastics. To the base 22 is swingably attached a frame 28 by a pin 26. A motor 30 is fixed to the frame 28, while a friction wheel 32 driven by the motor 30 is turnably secured to the same frame 28. The friction wheel 32 is pressed into with the circumference of the rotatable disc 16 by means of a spring 34 which holds the frame 28 elastically, thereby transmitting driving force of the motor 30 to the turning disc 16 for keeping it in rotatable.

Under the rotatable disc 16, magnets 38 are arranged on the bottom plate 36 of the base 22 at each position which aligns approximately with the center of the receiving part. Each magnet 38 may be either a permanent magnet or an electromagnet, provided that it has its poles disposed in the vertical direction. If permanent magnets are employed, they must be arranged with poles oriented at random. If electromagnets are used, their poles must be adapted to be electrically reversed.

The toy is provided with a fishing rod 40 for fishing up the small toy bodies 10. The fishing rod 40 is provided at its one end with a suspending rod 42 which in turn is provided at its lower end with a holding part 44 of non-magnetic material, such as plastic, for receiving a fishing magnet 46. The fishing rod 40 is swingably supported at its other end on a support 48 which is rotatable on its vertical shaft 50 on the base 22. Further, the fishing rod 40 is provided at its other end with a horizontal shaft 52 secured to the inner wall of the support 48 and is elastically pushed constantly upwards by means of an elastic element 54. Into the support 48 from its top is inserted a pushing rod 56, the lower end of which is in contact with the fishing rod 40 and is surrounded by a coil spring 58. Thus, pressing downward the pushing rod 56 with a finger against the force of the elastic element 54 and spring 58 permits the upper end of the fishing rod 40 and hence the fishing magnet 46 to be lowered to a suitable level.

Alternatively, the fishing rod 40 may be operated by hand without using the support 48.

Figure 4:
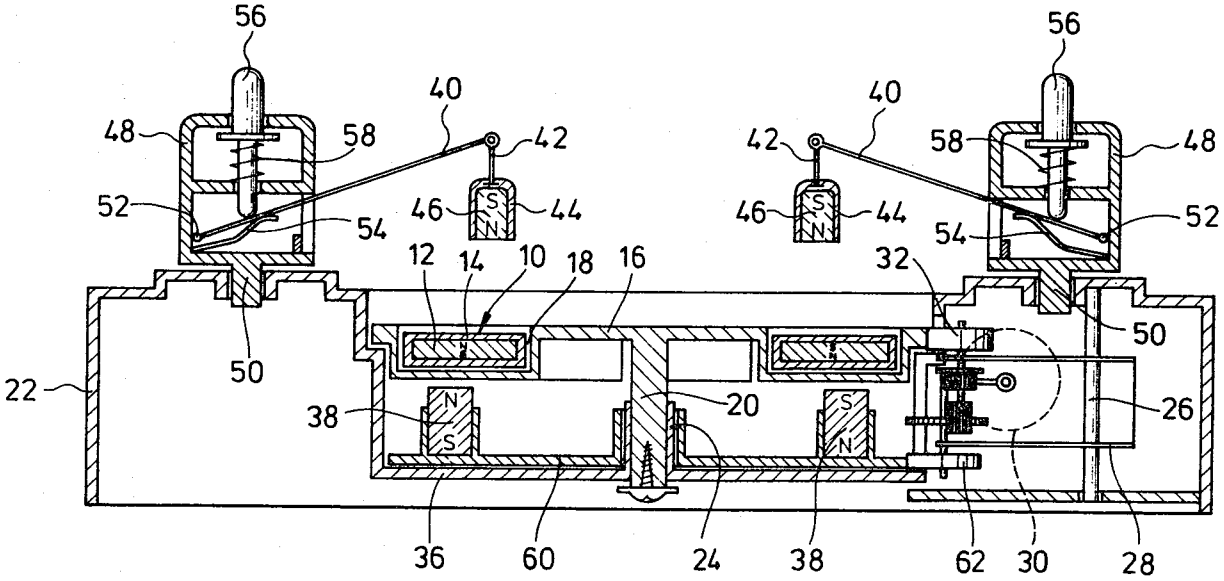
FIG. 4 is a vertical sectional view of another embodiment of the toy according to the invention, similar to that of FIG. 3.

Another embodiment of the toy according to the invention is illustrated in FIG. 4, wherein the magnets 38 are arranged on a second rotatable disc 60 instead of being fixed to the bottom plate 36 of the base 22, as in the embodiment of FIGS. 1 to 3. The second rotatable disc 60 is arranged adjacent to the bottom plate 36 and is rotatably supported to the bearing 24 upstanding from the base 22. Furthermore, to the frame 28 is rotatably secured a second friction wheel 62, which is in contact with the periphery of the second rotatable disc 60 for driving the latter by means of the motor 30. In this case, the second rotatable disc 60 may be turned in the opposite direction from the main disc 16, or in the same direction but with a different speed in relation to the main turning disc 16. In FIGS. 1 and 2, the fished toy bodies may be placed on resting sites 64.

As is apparent from the embodiments described hereinbefore, in accordance with the invention the small toy bodies 10 each containing the permanent magnet 12 are accommodated in the receiving parts 18 of the rotatable disc 16 individually and may be overturned under the repelling force generated when like poles face each other between the magnet of the small toy body 10 and the magnet 38 arranged under the disc 16 upon its rotation. This overturning of the small toy body 10 is conducted within the receiving part 18, thereby avoiding the attraction and connection between the adjacent small toy bodies 10.

Upon fishing the small toy body 10 by use of the fishing magnet 46 suspended from the upper end of the fishing rod 40, the small toy body 10 may be fished up individually only when opposite poles face each other between the magnet of the small toy body 10 and the fishing magnet 46.

Thus, in accordance with the invention, a plurality of identical receiving parts 18 are arranged on the rotatably disc 10, in which magnets each having a different polarity are randomly accommodated, resulting in a more exciting fishing toy.

Although small toy bodies of disc shape are used in the embodiments shown in FIGS. 1 to 4, they may be of any shape, such as polygonal, fish-like and other shapes. Furthermore, the receiving part may be formed by arranging a defining plate on the flat surface of the turning disc instead of the recess as described hereinabove. The toy is optionally provided at its base with a battery and a switch.

The invention has been described by its preferred embodiments but it should be understood that many modifications may be made without departing from the scope and spirit of the invention.

What is claimed is:

1. A fishing toy comprising a plurality of small toy bodies each containing a magnet therein, a rotatable disc consisting of a non-magnetic body and having a plurality of receiving parts each accommodating a said small toy body individually, a base on which said rotatable disc is rotatably mounted, a driving means mounted to said base for rotating said disc, magnets arranged under said disc each corresponding to a said receiving part for overturning a said small toy body by magnetic repulsion, and a fishing rod provided with a magnet for fishing up and holding a said small toy body by magnetic attraction.

2. The fishing toy according to claim 1, wherein the driving means for rotating the disc comprises a friction wheel in contact with the periphery of the disc and a motor for driving said friction wheel.

3. The fishing toy according to claim 1, wherein the magnets for overturning the small toy bodies comprise permanent magnets.

4. The fishing toy according to claim 1, wherein the magnets for overturning the small toy bodies comprise electromagnets capable of switching polarity.

5. The fishing toy according to claim 1, wherein the magnets for overturning the small toy bodies are mounted on a second rotatable disc which rotates in the opposite direction from the first-mentioned rotatable disc.

6. A fishing toy according to claim 1, wherein the magnets for overturning the small toy bodies are mounted on a second rotatable disc which rotates in the same direction as the first-mentioned rotatable disc but at a different speed.

7. The fishing toy according to claim 1, wherein the fishing rod is swingably mounted on a support on said base and is adapted to move the last-named magnet up and down.

8. The fishing toy according to claim 1, wherein the last-named magnet is received in a holding part of a non-magnetic body attached to a suspending rod at its lower end, said suspending rod being suspended from the upper end of the fishing rod.

* * * * *